US007554443B1

(12) United States Patent
Alexander et al.

(10) Patent No.: US 7,554,443 B1
(45) Date of Patent: Jun. 30, 2009

(54) UNIVERSAL REMOTE CONTROL FINDER

(76) Inventors: Broderick Alexander, 615 N. Maple St., North Little Rock, AR (US) 72114; Thomas S. Krol, 2014 Ford Rd., Unit B, Bristol, PA (US) 19007

( * ) Notice: Subject to any disclaimer, the term of this patent is extended or adjusted under 35 U.S.C. 154(b) by 251 days.

(21) Appl. No.: 11/731,859

(22) Filed: Apr. 2, 2007

(51) Int. Cl.
*G08B 1/08* (2006.01)

(52) U.S. Cl. ..... 340/539.32; 340/539.1; 340/539.11; 340/571; 340/573.4; 340/825.36; 340/825.49; 340/825.69; 348/734

(58) Field of Classification Search ..... 340/539.32, 340/539.1, 539.11, 539.13, 539.14, 505, 340/571, 572.1, 573.4, 825.36, 825.49, 825.69, 340/825.72; 348/734
See application file for complete search history.

(56) References Cited

U.S. PATENT DOCUMENTS 6,445,290 B1 * 9/2002 Fingal et al. ..... 340/539.32
2008/0186176 A1 * 8/2008 Hardacker et al. ..... 340/572.1

* cited by examiner

*Primary Examiner*—Hung T. Nguyen

(57) ABSTRACT

The universal remote control finder includes a receiving station that is connected to an internal power supply source of the remote control so that the receiving station remains coupled to the power supply source. The receiving station is intercalated between the remote control and the base station when the remote control is docked at the base station. A base station is coupled to an external 120-volt power supply source and includes a user interface with a toggle switch. The receiving station is electrically mated with the base station. The remote control remains spaced above the base station during charging conditions. After the receiving station is detached from the base station and the toggle switch is activated, the base station generates and transmits an RF location signal. The receiving station detects the signal and emits an identification signal to identify a location of the remote control.

15 Claims, 8 Drawing Sheets

UNIVERSAL REMOTE CONTROL FINDER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to wireless remote control finders and, more particularly, to a universal wireless remote control finder that assists a user to find a battery-operated remote control.

2. Prior Art

Various electronic devices such as televisions, stereos, video cassette recorders and the like, are controlled from remote locations by use of a hand held remote control device. Remote control devices are capable of generating signals, such as infrared or RF, for transmission to the electronic device. The electronic device is adapted to receive the transmitted signal and based upon the received signal to operate a function of the electronic device, such as change a channel or increase the volume. Although remote control devices are useful, one problem associated with their use is that because of their size they are easily lost or misplaced. As such, a variety of systems and devices have been introduced in the prior art to overcome the above-noted problem.

One prior art example shows a system that includes both a transmitter and a receiver. The transmitter broadcasts a transmitted signal for a fixed duration of time when the user activates a manually actuated button. The receiver is attached to the object to be located and contains an audible signal generator circuit for emitting an audible signal when the receiver detects the transmitted signal from the transmitter. The audible signal assists the user in tracing the sound back to the source of the audible signal and locating the lost object. Unfortunately, this system requires reactivating the transmitter if the remote device is not found within the fixed duration of time the signal is transmitted. Additionally, this system provides only an audible location signal.

Another prior art example shows a system that includes a remote finder that sends a radio signal to a selected one of a plurality of button-shaped receivers that emits an audible beeping noise upon activation by the appropriate radio signal. The receiver attaches to the back of a remote device by a sticker. The remote control transmitter fits into a wall-mounted bracket when not in use. A drawback to this system is the use of adhesive stickers, which will leave a residue upon the object being adhered to, as well as possibly becoming detached from the object being located, thus rendering the system useless for its intended purpose. Also, the transmitter housing must be affixed to a wall which can cause damage to the wall, or be aesthetically unpleasant. Additionally, this system also only has an audible signal for location purposes.

Accordingly, a need remains for a universal remote control finder to overcome the above noted short-comings. The present invention satisfies such a need by providing a device that is convenient and easy to use, is durable yet lightweight in design, is relatively inexpensive to produce, and attaches to many types of remote control devices. Such a device identifies the location of the remote device by emitting an audible signal, flashing LED indicators, or causing the remote device to vibrate, thus increasing the likelihood of a user finding the misplaced remote control. The device can conveniently be placed out of sight within an entertainment center, for example, thus ensuring that it does not intrude on the décor of the room. The remote control finder's docking station also serves to continuously charge the remote locating receiver, thus advantageously ensuring that the device is always functional.

BRIEF SUMMARY OF THE INVENTION

In view of the foregoing background, it is therefore an object of the present invention to provide a universal remote control finder. These and other objects, features, and advantages of the invention are provided by a wireless object locating system for assisting a user to find a battery-operated remote control.

The universal remote control finder includes a portable receiving station that is removably connected directly to an existing internal power supply source of the remote control in such a manner that the receiving station remains statically coupled to the internal power supply source during operating conditions. The receiving station is advantageously intercalated between the remote control and the base station when the remote control is docked at the base station. Such a receiving station preferably includes a rechargeable power supply source electrically coupled to the existing internal power supply source of the remote control.

The receiving station has a convenient DC power jack and a voltage regulator electrically coupled to the rechargeable power supply source. Such a receiving station also includes a paging circuit for effectively generating and transmitting the identification signal, and a plurality of transducers including a vibrator and a LED electrically coupled to the paging circuit respectively. The paging circuit effectively activates the transducers for a predetermined period of time when the base station detects the identification signal. The receiving station preferably further includes a convenient spring-actuator and a plurality of conductive wires connected thereto. Such a spring-actuator is directly and electrically mated with the rechargeable power supply source of the receiving station and the existing internal power supply source of the base station respectively, so that the rechargeable power supply source is advantageously automatically recharged when the receiving station is docked at the base station.

The receiving station may also further include a primary support surface that has a planar top face extending along a major longitudinal length thereof. Such a top face has a convenient rear L-shaped bracket directly mated to the top face, and the rear bracket has a vertically registered bore formed therein. A front bracket is directly mated to the top face and is obliquely offset from a horizontal plane and slopes upwardly away from the rear bracket. The front bracket has a vertically registered bore formed therein. The receiving station also includes a top shield that advantageously extends along a major longitudinal length of the top face. The top shield has first and second linear anchor arms directly and removably positional into the bores of the rear and front brackets for effectively securing the top shield to the brackets respectively. A fastener is threadably penetrated through the spring-actuator such that the spring-actuator remains dynamically affixed to the rear bracket and compresses along a linear path oriented perpendicular to the first and second anchor arms respectively.

A base station is electrically coupled to an external 120-volt power supply source. Such a base station conveniently includes a user interface provided with a toggle switch that is electrically coupled thereto. Such a receiving station is removably and electrically mated with the base station such that the internal power supply source of the remote control is effectively charged during non-operating conditions. The remote control remains conveniently spaced above the base station during charging conditions. After the receiving station is detached from the base station and the toggle switch is switched to an active position respectively, the base station effectively generates and wirelessly transmits an RF location signal. The receiving station detects the RF location signal, and in response, emits an identification signal to conveniently notify the user of a location of the remote control.

The base station further may have a universal charging circuit is electrically coupled to an external A/C power supply source. A male charging jack is removably connected and electrically coupled to the DC power jack for effectively charging the rechargeable power supply source. A voltage regulator and a transmitter are electrically coupled to the voltage regulator of the base station. Such a transmitter is in direct communication with the toggle switch such that the detection signal is automatically transmitted when the toggle switch is adapted to the active position and the receiving station is electrically detached from the base station respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
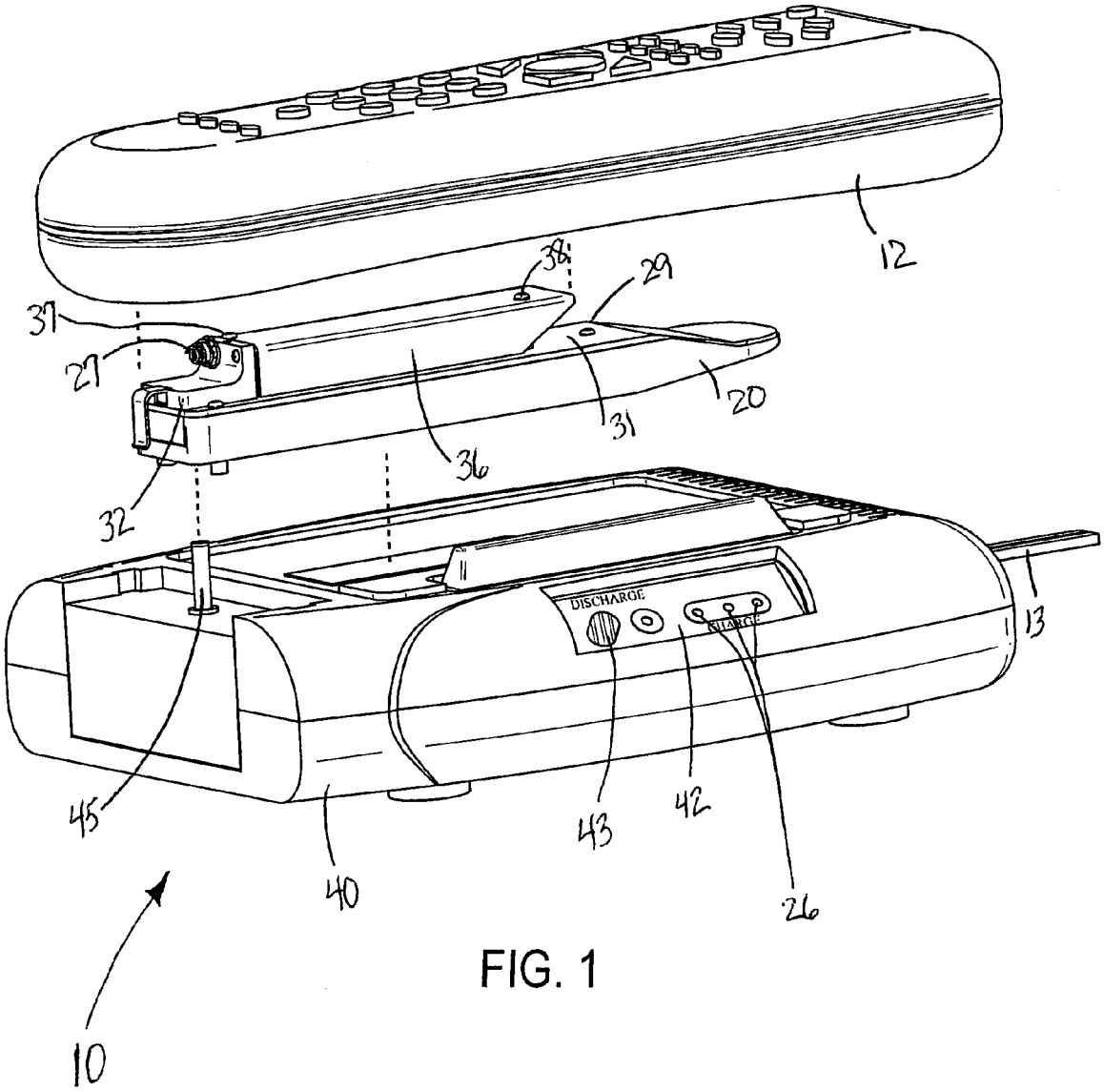
FIG. 1 is a perspective view showing a universal remote control finder, in accordance with the present invention.
Figure 2:
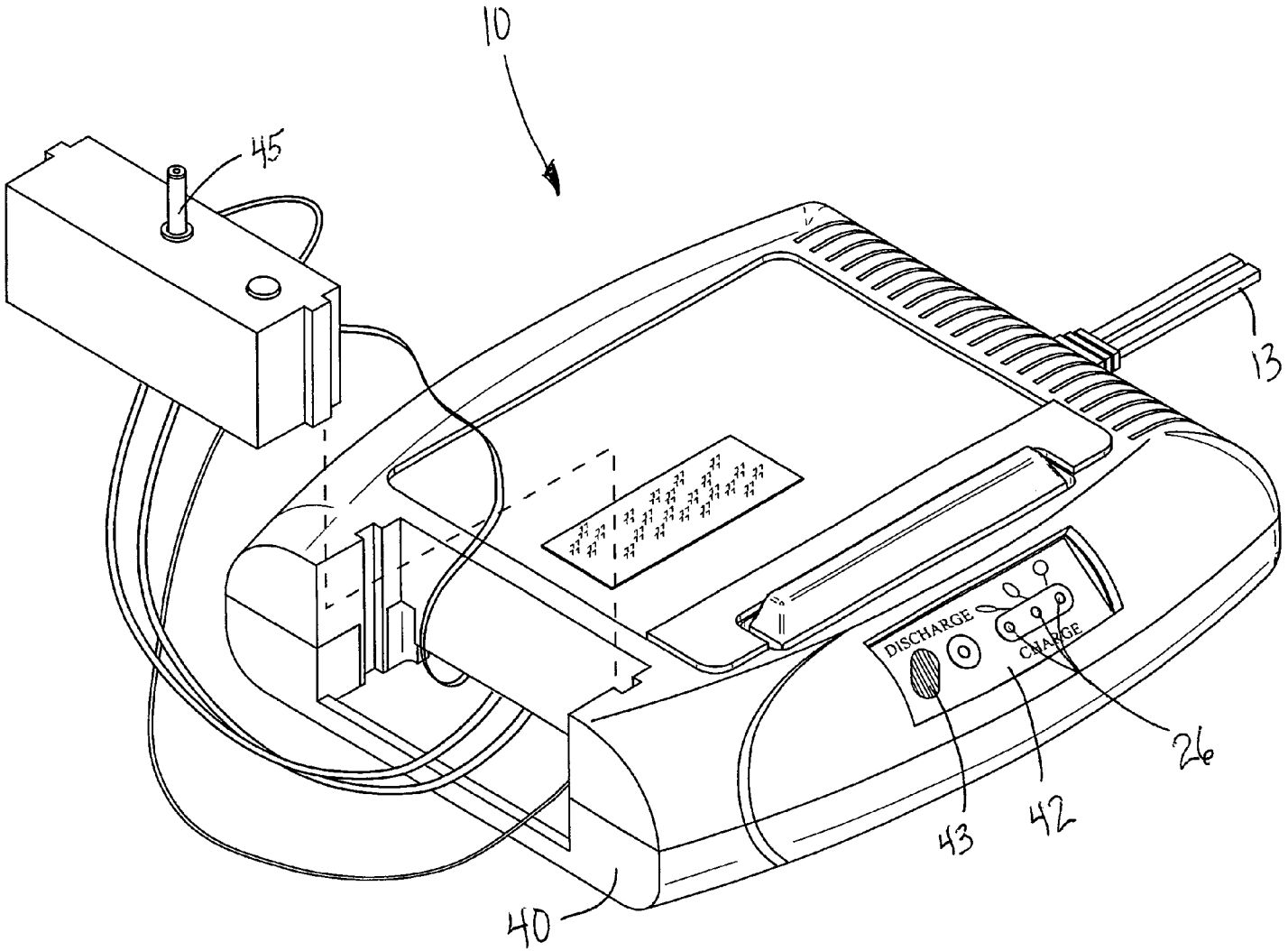
FIG. 2 is a perspective view of the base station shown in FIG. 1.
Figure 3:
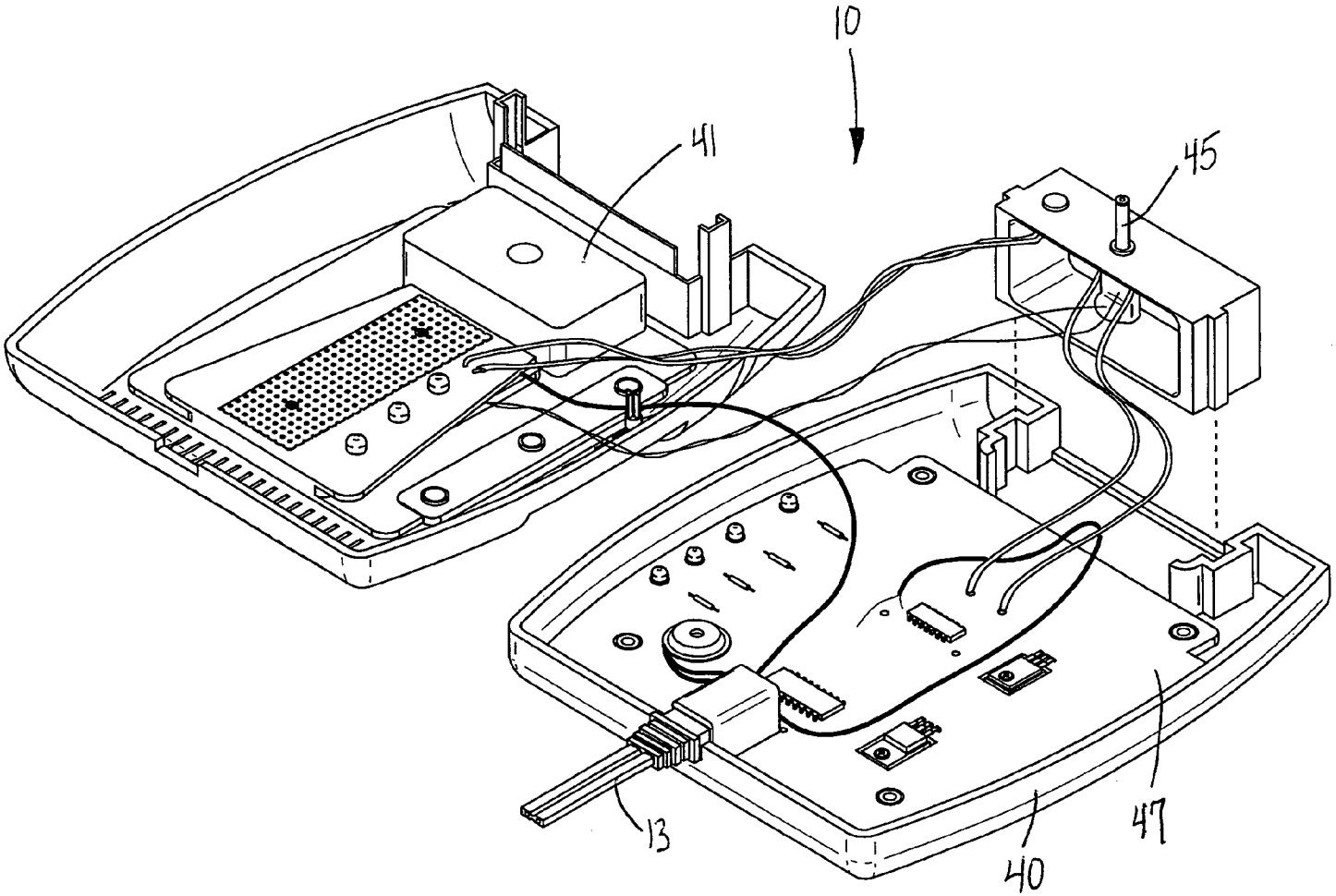
FIG. 3 is an exploded perspective view of the base station shown in FIG. 2.
Figure 4:
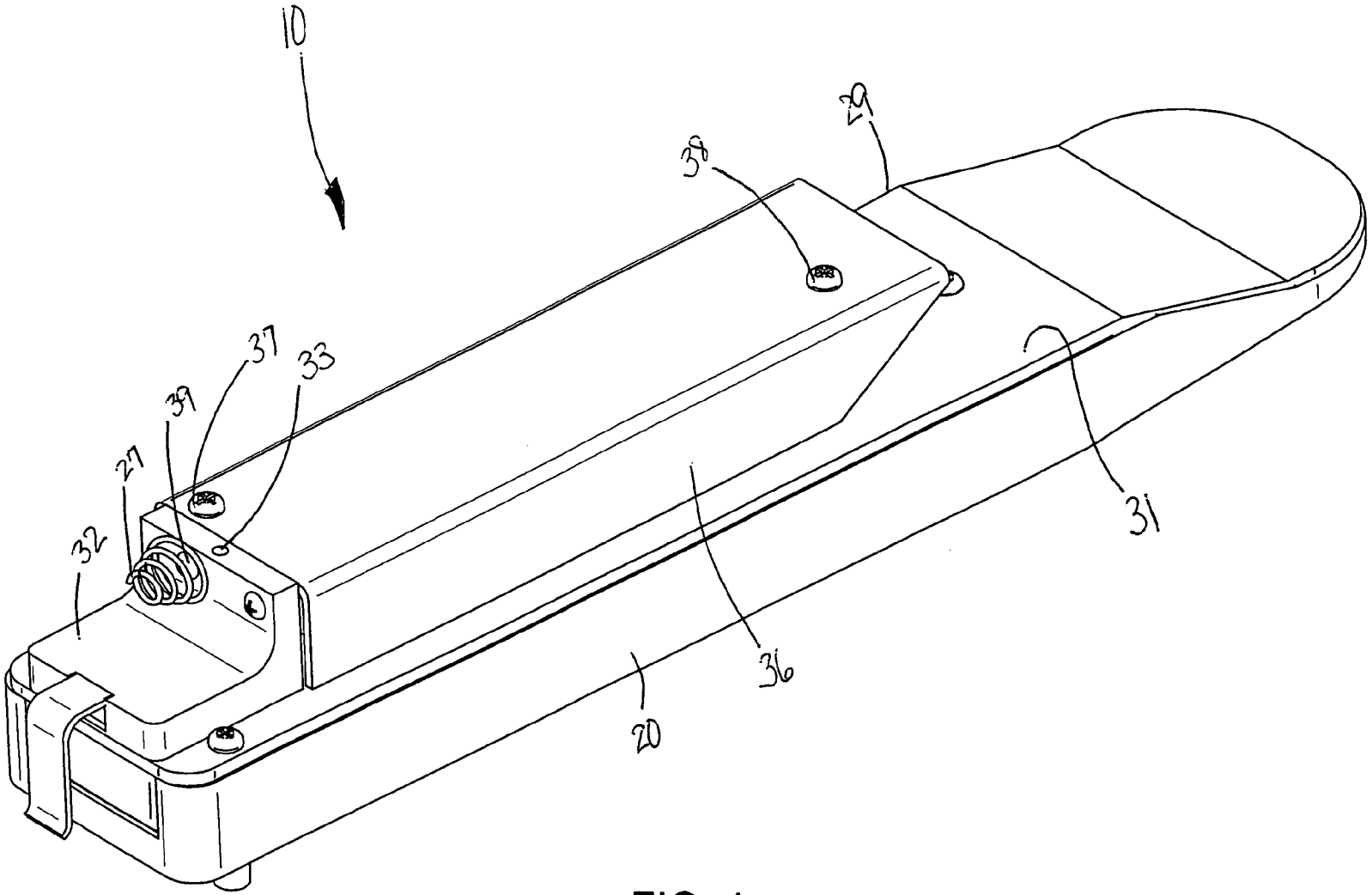
FIG. 4 is a perspective view of the receiving station shown in FIG. 1.
Figure 5:
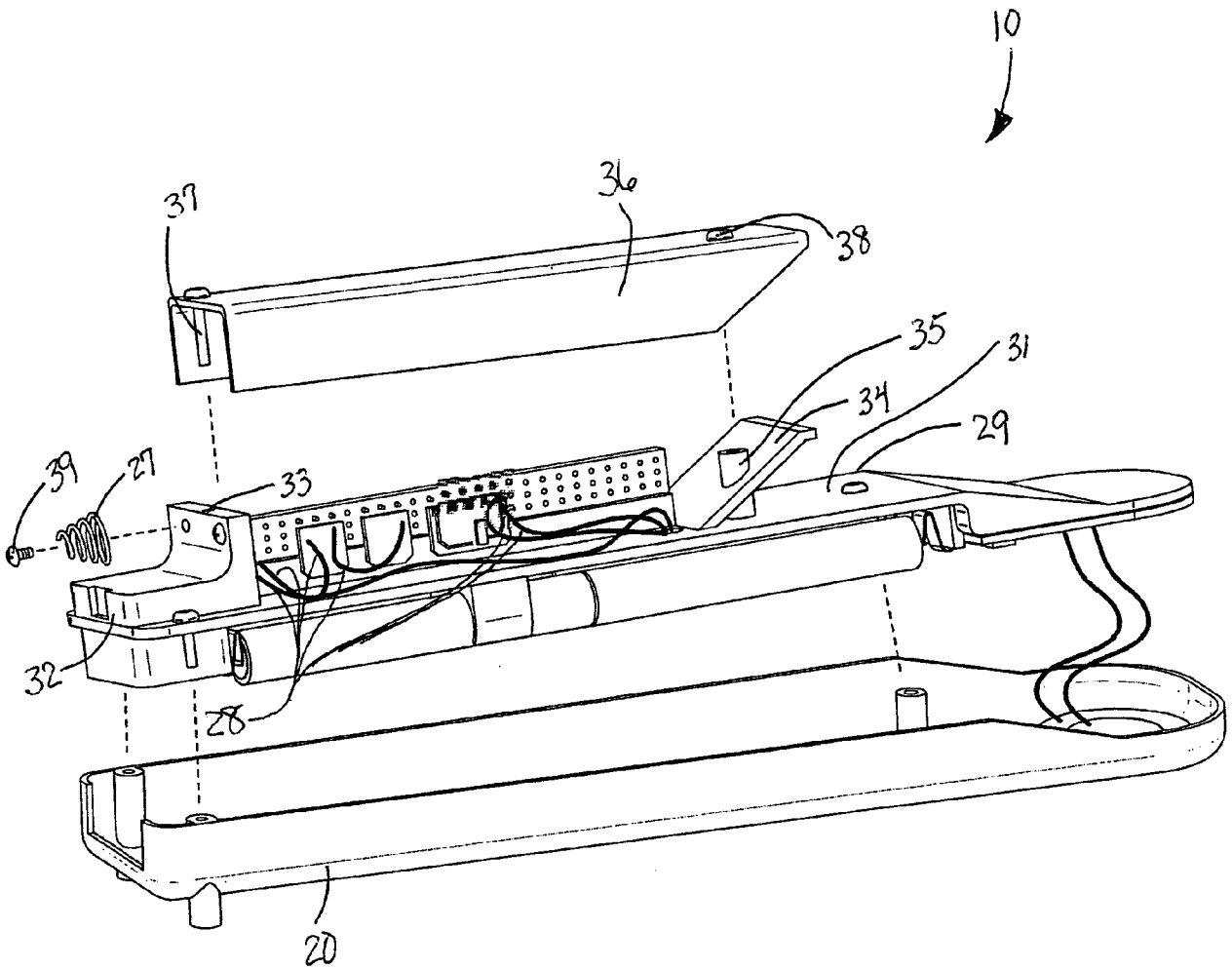
FIG. 5 is an exploded top perspective view of the receiving station shown in FIG. 4.
Figure 6:
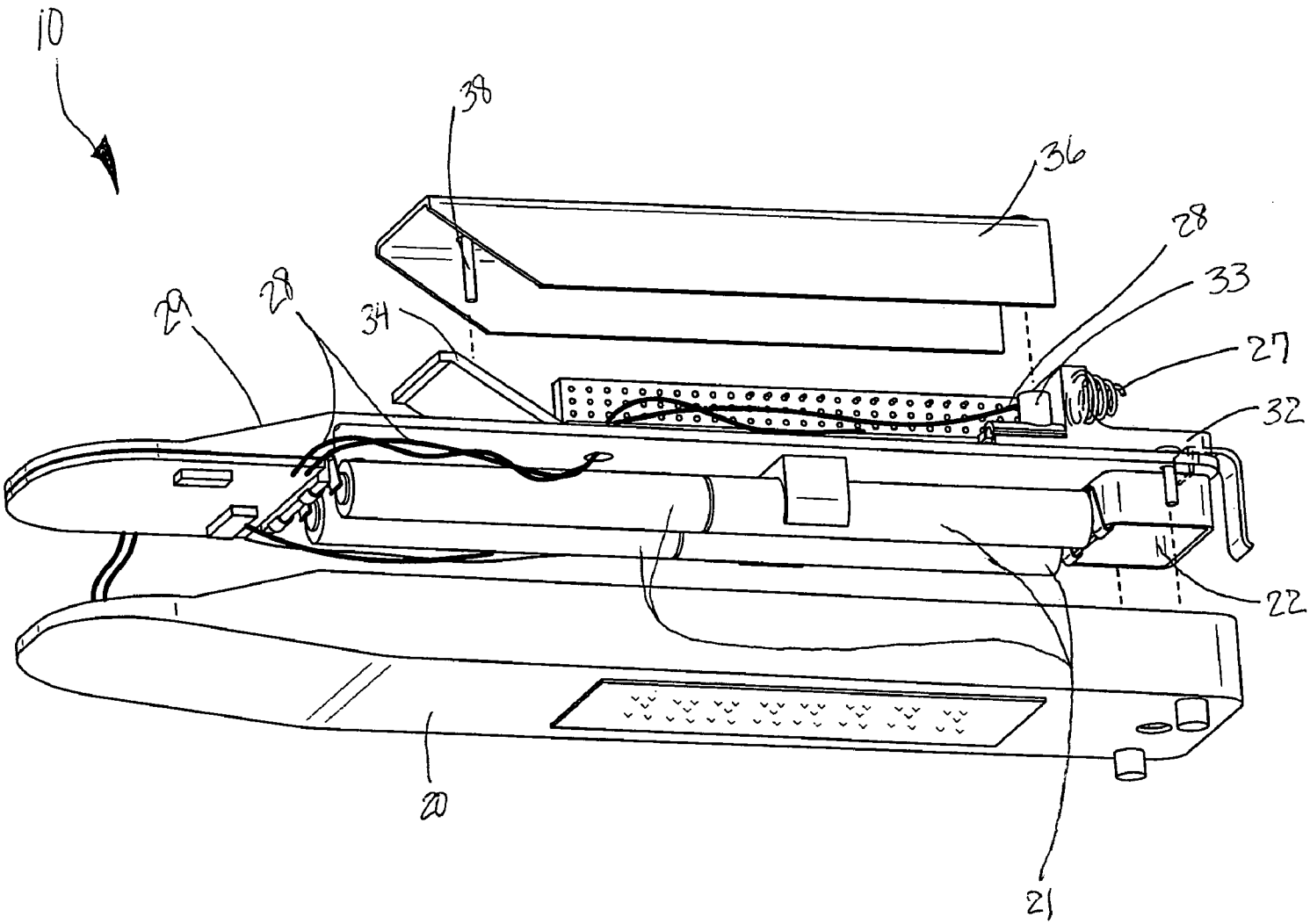
FIG. 6 is another exploded bottom perspective view of the receiving station shown in FIG. 4.
Figure 7:
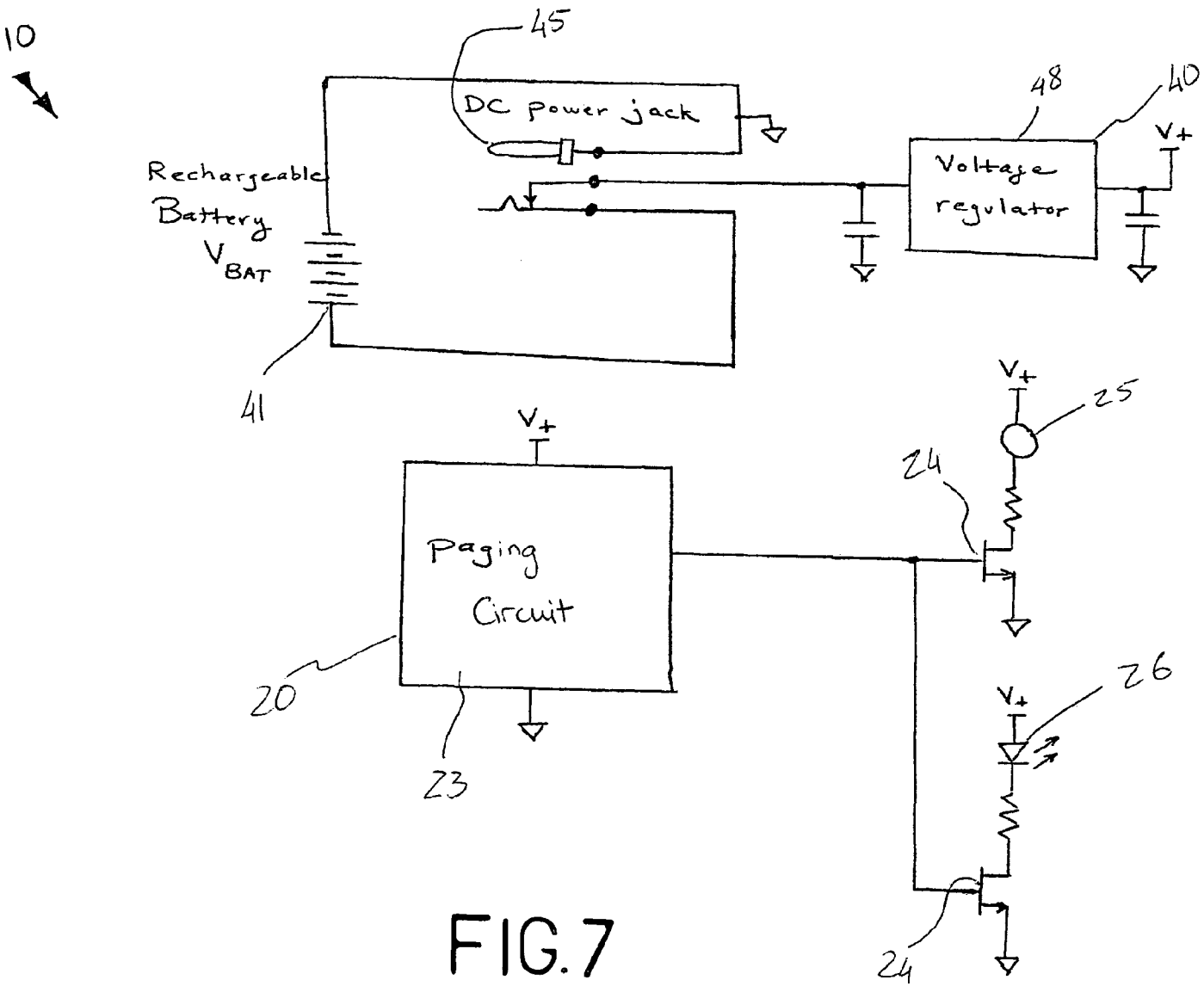
FIG. 7 is a schematic block diagram of the device shown in FIG. 1.
Figure 8:
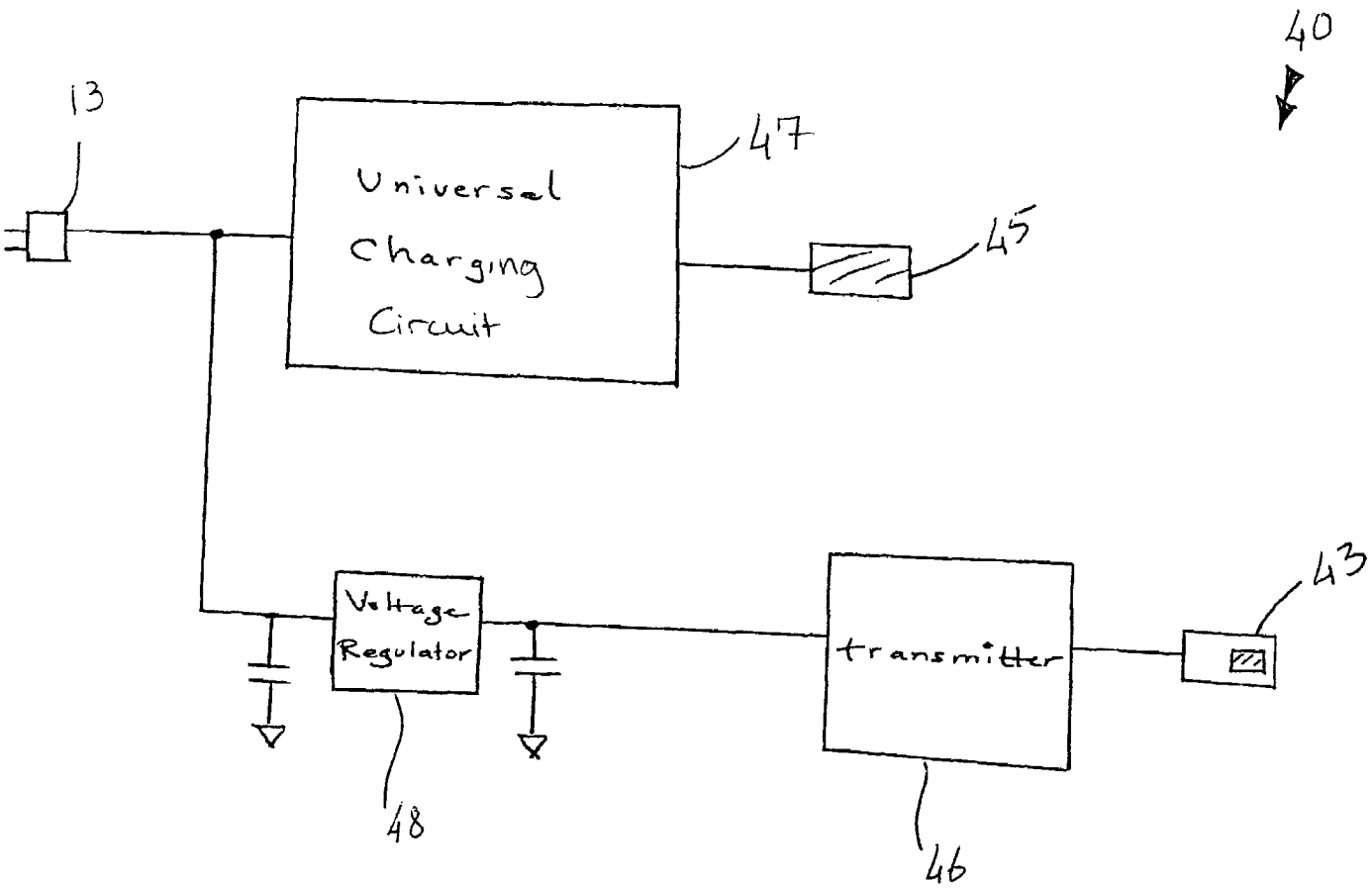
FIG. 8 is a schematic block diagram of the base station shown in FIG. 1.

The device of this invention is referred to generally in FIGS. 1-8 by the reference numeral 10 and is intended to provide a universal remote control finder. It should be understood that the device 10 may be used to locate many different types of remote control devices and should not be limited in use to only locating one type of remote control device.

Referring initially to FIGS. 1, 2, 3, 4, 5, 6, 7 and 8, the device 10 includes a portable receiving station 20 that is removably connected directly, without the use of intervening elements, to an existing internal power supply source 11 of the remote control 12 in such a manner that the receiving station 20 remains statically coupled to the internal power supply source 11 during operating conditions. The receiving station 20 is advantageously intercalated between the remote control 12 and the base station 40 when the remote control 12 is docked at the base station 40. Such a receiving station 20 includes a rechargeable power supply source 21 electrically coupled to the existing internal power supply source 11 of the remote control 12.

Again referring to FIGS. 1 through 8, the receiving station 20 has a convenient DC power jack 22 and a voltage regulator 23 electrically coupled to the rechargeable power supply source 21. Such a receiving station 20 also conveniently includes a paging circuit 23 for effectively generating and transmitting the identification signal, and a plurality of transducers 24 including a vibrator 25 and an LED 26 electrically coupled to the paging circuit 23 respectively. The paging circuit 23 effectively activates the transducers 24 for a predetermined period of time when the base station 40 detects the identification signal. The receiving station 20 further includes a convenient spring-actuator 27 and a plurality of conductive wires 28 advantageously connected thereto. Such a spring-actuator 27 is directly, without the use of intervening elements, and electrically mated with the rechargeable power supply source 21 of the receiving station 20 and the existing internal power supply source 41 of the base station 40 respectively, so that the rechargeable power supply source 21 is advantageously automatically recharged when the receiving station 20 is docked at the base station 40.

Referring to FIGS. 1, 4, 5, 6, and 7, the receiving station 20 further includes a primary support surface 29 that has a planar top face 31 extending along a major longitudinal length thereof. Such a top face 31 has a convenient rear L-shaped bracket 32 directly mated, without the use of intervening elements, to the top face 31, and the rear bracket 32 has a vertically registered bore 33 formed therein. A front bracket 34 is directly mated, without the use of intervening elements, to the top face 31 and is obliquely offset from a horizontal plane and slopes upwardly away from the rear bracket 32. The front bracket 34 has a vertically registered bore 35 formed therein. The receiving station 20 also includes a top shield 36 that advantageously extends along a major longitudinal length of the top face 31. The top shield 36 has first 37 and second 38 linear anchor arms directly and removably positional, without the use of intervening elements, into the bores 33, 35 of the rear 32 and front 34 brackets for effectively securing the top shield 36 to the brackets 32, 34 respectively. A fastener 39 is threadably penetrated through the spring-actuator 27 such that the spring-actuator 27 remains dynamically affixed to the rear bracket 32 and compresses along a linear path oriented perpendicular to the first 37 and second 38 anchor arms respectively.

Referring to FIGS. 1 through 8, a base station 40 is electrically coupled to an external 120-volt power supply source 13. Such a base station 40 conveniently includes a user interface 42 provided with a toggle switch 43 that is electrically coupled thereto, and crucial for proper operation of the device. The receiving station 20 is removably and electrically mated with the base station 40 such that the internal power supply source 11 of the remote control 12 is effectively charged during non-operating conditions. The remote control 12 remains conveniently spaced above the base station 40 during charging conditions.

After the receiving station 20 is detached from the base station 40 and the toggle switch 43 is switched to an active position respectively, the base station 40 effectively generates and wirelessly transmits an RF location signal. The receiving station 20 effectively detects the RF location signal, and in response, emits an identification signal to conveniently notify the user of a location of the remote control 12.

Still referring to FIGS. 1 through 8, the base station 40 further has a universal charging circuit 47 is electrically coupled to an external A/C power supply source 13. A male charging jack 45 is removably connected and electrically coupled to the DC power jack 22 for effectively charging the rechargeable power supply source 21. A voltage regulator 48 and a transmitter 46 are electrically coupled to the universal charging circuit 47 of the base station 40. Such a transmitter 46 is in direct communication with the toggle switch 43 such that the detection signal is automatically and effectively transmitted when the toggle switch 43 is adapted to the active position and the receiving station 20 is electrically detached from the base station 40 respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wireless object locating system for assisting a user to find a battery-operated remote control, said wireless object locating system comprising:

a portable receiving station removably connected directly to an existing internal power supply source of the remote control in such a manner that said receiving station remains statically coupled to the internal power supply source during operating conditions; and a base station electrically coupled to an external 120-volt power supply source, said base station comprising a user interface provided with a toggle switch electrically coupled thereto;

wherein said receiving station is intercalated between the remote control and said base station when the remote control is docked at said base station;

wherein said receiving station is removably and electrically mated with said base station such that the internal power supply source of the remote control is charged during non-operating conditions, the remote control remaining spaced above said base station during charging conditions;

where after said receiving station is detached from said base station and said toggle switch is switched to an active position respectively, said base station generating and wirelessly transmitting a RF location signal, said receiving station detecting said RF location signal and in response emitting an identification signal to notify the user of a location of the remote control.

2. The device of claim 1, wherein said receiving station comprises:

a rechargeable power supply source electrically coupled to the existing internal power supply source of the remote control;

a DC power jack electrically coupled to said rechargeable power supply source;

a voltage regulator electrically coupled to said rechargeable power supply source;

a paging circuit for generating and transmitting said identification signal; and a plurality of transducers including a vibrator and a LED electrically coupled to said paging circuit respectively;

wherein said paging circuit activates said transducers for a predetermined period of time when said base station detects said identification signal.

3. The device of claim 1, wherein said base station further comprises:

a universal charging circuit electrically coupled to an external A/C power supply source;

a male charging jack removably connected and electrically coupled to said DC power jack for charging said rechargeable power supply source;

a voltage regulator;

a transmitter electrically coupled to said voltage regulator of said base station, said transmitter being in direct communication with said toggle switch such that said detection signal is automatically transmitted when said toggle switch is adapted to the active position and said receiving station is electrically detached from said base station respectively.

4. The device of claim 2, wherein said receiving station further comprises:

a spring-actuator and a plurality of conductive wires connected thereto, said spring-actuator being directly and electrically mated with said rechargeable power supply source of said receiving station and the existing internal power supply source of said base station respectively so that said rechargeable power supply source is automatically recharged when said receiving station is docked at said base station.

5. The device of claim 4, wherein said receiving station further comprises:

a primary support surface having a planar top face extending along a major longitudinal length thereof;

a rear L-shaped bracket directly mated to said top face, said rear bracket having a vertically registered bore formed therein;

a front bracket directly mated to said top face, said front bracket being obliquely offset from a horizontal plane and sloping upwardly away from said rear bracket, said front bracket having a vertically registered bore formed therein;

a top shield extending along a major longitudinal length of said top face, said top shield having first and second linear anchor arms directly and removably positional into said bores of said rear and front brackets for securing said top shield to said brackets respectively; and a fastener threadably penetrated through said spring-actuator such that said spring-actuator remains dynamically affixed to said rear bracket and compresses along a linear path oriented perpendicular to said first and second anchor arms respectively.

6. A wireless object locating system for assisting a user to find a battery-operated remote control, said wireless object locating system comprising:

a portable receiving station removably connected directly to an existing internal power supply source of the remote control in such a manner that said receiving station remains statically coupled to the internal power supply source during operating conditions; and a base station electrically coupled to an external 120-volt power supply source, said base station comprising a user interface provided with a toggle switch electrically coupled thereto;

wherein said receiving station is intercalated between the remote control and said base station when the remote control is docked at said base station;

wherein said receiving station is removably and electrically mated with said base station such that the internal power supply source of the remote control is charged during non-operating conditions, the remote control remaining spaced above said base station during charging conditions;

where after said receiving station is detached from said base station and said toggle switch is switched to an active position respectively, said base station generating and wirelessly transmitting a RF location signal, said receiving station detecting said RF location signal and in response emitting an identification signal to notify the user of a location of the remote control.

7. The device of claim 6, wherein said receiving station comprises:

a rechargeable power supply source electrically coupled to the existing internal power supply source of the remote control;

a DC power jack electrically coupled to said rechargeable power supply source;

a voltage regulator electrically coupled to said rechargeable power supply source;

a paging circuit for generating and transmitting said identification signal; and a plurality of transducers including a vibrator and a LED electrically coupled to said paging circuit respectively;

wherein said paging circuit activates said transducers for a predetermined period of time when said base station detects said identification signal.

8. The device of claim 6, wherein said base station further comprises:

a universal charging circuit electrically coupled to an external A/C power supply source;

a male charging jack removably connected and electrically coupled to said DC power jack for charging said rechargeable power supply source;

a voltage regulator;

a transmitter electrically coupled to said voltage regulator of said base station, said transmitter being in direct communication with said toggle switch such that said detection signal is automatically transmitted when said toggle switch is adapted to the active position and said receiving station is electrically detached from said base station respectively.

9. The device of claim 7, wherein said receiving station further comprises:

a spring-actuator and a plurality of conductive wires connected thereto, said spring-actuator being directly and electrically mated with said rechargeable power supply source of said receiving station and the existing internal power supply source of said base station respectively so that said rechargeable power supply source is automatically recharged when said receiving station is docked at said base station.

10. The device of claim 9, wherein said receiving station further comprises:

a primary support surface having a planar top face extending along a major longitudinal length thereof;

a rear L-shaped bracket directly mated to said top face, said rear bracket having a vertically registered bore formed therein;

a front bracket directly mated to said top face, said front bracket being obliquely offset from a horizontal plane and sloping upwardly away from said rear bracket, said front bracket having a vertically registered bore formed therein;

a top shield extending along a major longitudinal length of said top face, said top shield having first and second linear anchor arms directly and removably positional into said bores of said rear and front brackets for securing said top shield to said brackets respectively; and a fastener threadably penetrated through said spring-actuator such that said spring-actuator remains dynamically affixed to said rear bracket and compresses along a linear path oriented perpendicular to said first and second anchor arms respectively.

11. A wireless object locating system for assisting a user to find a battery-operated remote control, said wireless object locating system comprising:

a portable receiving station removably connected directly to an existing internal power supply source of the remote control in such a manner that said receiving station remains statically coupled to the internal power supply source during operating conditions; and a base station electrically coupled to an external 120-volt power supply source, said base station comprising a user interface provided with a toggle switch electrically coupled thereto, wherein said toggle switch is removably attached to said base station;

wherein said receiving station is intercalated between the remote control and said base station when the remote control is docked at said base station;

wherein said receiving station is removably and electrically mated with said base station such that the internal power supply source of the remote control is charged during non-operating conditions, the remote control remaining spaced above said base station during charging conditions;

where after said receiving station is detached from said base station and said toggle switch is switched to an active position respectively, said base station generating and wirelessly transmitting a RF location signal, said receiving station detecting said RF location signal and in response emitting an identification signal to notify the user of a location of the remote control.

12. The device of claim 11, wherein said receiving station comprises:

a rechargeable power supply source electrically coupled to the existing internal power supply source of the remote control;

a DC power jack electrically coupled to said rechargeable power supply source;

a voltage regulator electrically coupled to said rechargeable power supply source;

a paging circuit for generating and transmitting said identification signal; and a plurality of transducers including a vibrator and a LED electrically coupled to said paging circuit respectively;

wherein said paging circuit activates said transducers for a predetermined period of time when said base station detects said identification signal.

13. The device of claim 11, wherein said base station further comprises:

a universal charging circuit electrically coupled to an external A/C power supply source;

a male charging jack removably connected and electrically coupled to said DC power jack for charging said rechargeable power supply source;

a voltage regulator;

a transmitter electrically coupled to said voltage regulator of said base station, said transmitter being in direct communication with said toggle switch such that said detection signal is automatically transmitted when said toggle switch is adapted to the active position and said receiving station is electrically detached from said base station respectively.

14. The device of claim 12, wherein said receiving station further comprises:

a spring-actuator and a plurality of conductive wires connected thereto, said spring-actuator being directly and electrically mated with said rechargeable power supply source of said receiving station and the existing internal power supply source of said base station respectively so that said rechargeable power supply source is automatically recharged when said receiving station is docked at said base station.

15. The device of claim 14, wherein said receiving station further comprises:

a primary support surface having a planar top face extending along a major longitudinal length thereof;

a rear L-shaped bracket directly mated to said top face, said rear bracket having a vertically registered bore formed therein;

a front bracket directly mated to said top face, said front bracket being obliquely offset from a horizontal plane and sloping upwardly away from said rear bracket, said front bracket having a vertically registered bore formed therein;

a top shield extending along a major longitudinal length of said top face, said top shield having first and second linear anchor arms directly and removably positional into said bores of said rear and front brackets for securing said top shield to said brackets respectively; and a fastener threadably penetrated through said spring-actuator such that said spring-actuator remains dynamically affixed to said rear bracket and compresses along a linear path oriented perpendicular to said first and second anchor arms respectively.

* * * * *